US005962379A

United States Patent [19]

Carey et al.

[11] Patent Number: 5,962,379

[45] Date of Patent: Oct. 5, 1999

[54] FRICTION REDUCING ADDITIVES FOR FUELS AND LUBRICANTS

[75] Inventors: James Thomas Carey, Medford; Halou Oumar-Mahamat, Princeton, both of N.J.

[73] Assignee: Mobil Oil Corporation, Fairfax, Va.

[21] Appl. No.: 09/166,669

[22] Filed: Oct. 5, 1998

Related U.S. Application Data

[62] Division of application No. 08/844,048, Apr. 18, 1997, Pat. No. 5,863,302.

[51] Int. Cl.[6] ..... C10M 133/02; C10M 133/52

[52] U.S. Cl. ..... 508/464

[58] Field of Search ..... 508/464

[56] References Cited

U.S. PATENT DOCUMENTS

| | | | |
|---|---|---|---|
| 2,161,615 | 6/1939 | Dietrich | 508/464 |
| 2,921,900 | 1/1960 | Remes et al. | 508/464 |
| 3,096,285 | 7/1963 | Huttenlocher et al. | 508/464 |
| 4,585,566 | 4/1986 | Wollenberg | 508/464 |
| 4,713,188 | 12/1987 | Wollenberg | 508/464 |
| 4,729,842 | 3/1988 | Wollenberg | 508/464 |
| 4,746,447 | 5/1988 | Wollenberg | 508/464 |
| 5,863,302 | 1/1999 | Carey et al. | 44/387 |

*Primary Examiner*—Jerry D. Johnson
*Attorney, Agent, or Firm*—Lori F. Cuomo; Dennis P. Santini

[57] ABSTRACT

The invention provides certain carbonates which have been prepared by reacting alkylamines with dialkylcarbonates and/or alkylene carbonates, and their use as friction reducing additives in fuels and lubes.

12 Claims, No Drawings

FRICTION REDUCING ADDITIVES FOR FUELS AND LUBRICANTS

This is a divisional of application Ser. No. 08/844,048 now U.S. Pat. No. 5,863,302, filed on Apr. 18, 1997.

BACKGROUND OF THE INVENTION

This invention is directed to alkylamines which have been reacted with dialkylcarbonates and/or alkylene carbonates to form N-alkylalkylcarbamates and N-alkylhydroxyalkylcarbamates and the use of the resulting products as friction reducing additives in fuels and lubes. More particularly, it is directed to fuel and lubricating compositions and concentrates containing such friction reducing additives.

A major concern today is finding methods to reduce engine friction and fuel consumption in internal combustion engines which are safe for the environment and economically attractive. One means is to treat moving parts of such engines with lubricants containing friction reducing additives. Considerable work has been done in this area.

U.S. Pat. No. 4,617,026 discloses the use of monocarboxylic acid ester of trihydric alcohol, glycerol monooleate, as a friction reducing additive in fuels and lubricants promoting fuel economy in an internal combustion engine.

The use of fatty formamides is disclosed in U.S. Pat. Nos. 4,789,493; 4,808,196; and 4,867,752.

The use of fatty acid amides is disclosed in U.S. Pat. No. 4,280,916.

U.S. Pat. No. 4,406,803 discloses the use of alkane-1,2-diols in lubricants to improve fuel economy of an internal combustion engine.

U.S. Pat. No. 4,512,903 discloses amides prepared from mono or poly hydroxy substituted aliphatic monocarboxylic acids and primary or secondary amines which are useful as friction reducing agents.

Accordingly, it is an object of the present invention to provide a composition for reducing and/or preventing friction.

It is another object of the present invention to provide a method for reducing friction in the operation of an internal combustion engine.

SUMMARY OF THE INVENTION

The instant invention is directed to carbamates prepared via condensation of alkylamines and dialkylcarbonates and/or alkylene carbonates which have been found to be effective friction reducing additives for fuels, particularly gasoline, fuel additive concentrates, lubricants and lubricant additive concentrates, with good high temperature decomposing cleanliness.

In accordance with the invention, there is provided a lubricant composition comprising a lubricating oil or grease prepared therefrom and a friction reducing amount of a reaction product obtained by reacting

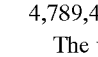

$RXR^1NH_2$ wherein $X=CH_2$, O, S, or NH;

R=hydrogen, hydrocarbyl, alkenyl, or alkyl ($C_1$ to $C_{60}$);

$R^1=C_1$ to $C_4$ alkenyl or substituted alkenyl; and dialkylcarbonate and/or alkylene carbonate.

There is further provided a fuel composition comprising an internal combustion engine fuel and a friction reducing amount of a product obtained by reacting

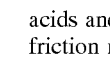

$RXR^1NH_2$ wherein $X=CH_2$, O, S, or NH;

R=hydrogen, hydrocarbyl, alkenyl, or alkyl ($C_1$ to $C_{60}$);

$R^1=C_1$ to $C_4$ alkenyl or substituted alkenyl; and dialkylcarbonate and/or alkylene carbonate.

There is still further provided a method for reducing and/or preventing friction in the operation of an internal combustion engine which comprises fueling said engine with a liquid fuel composition comprising per 1000 barrels of fuel between about 25 to about 250 pounds of a product obtained by reacting

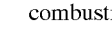

$RXR^1NH_2$ wherein $X=CH_2$, O, S, or NH;

R=hydrogen, hydrocarbyl, alkenyl, or alkyl ($C_1$ to $C_{60}$);

$R^1=C_1$ to $C_4$ alkenyl or substituted alkenyl; and dialkylcarbonate and/or alkylene carbonate.

DETAILED DESCRIPTION OF THE INVENTION

Reaction products of dialkylcarbonates and/or alkylene carbonates and alkylamines have been found to have excellent friction reduction properties coupled with excellent high temperature cleanliness and decomposition features necessary for use in high quality fuels and lubricants for internal combustion engines.

Suitable alkylamines include pure saturated or unsaturated monoamines and/or diamines or mixtures of alkylamines derived from fatty acids, such as coco, oleyl or tallow.

The alkylamines can also contain heteroatoms such as oxygen, sulfur or nitrogen in their alkyl chains. The alkyl groups on the amines are long enough to confer friction reduction properties but not too long to prevent the inherent waxiness of long chain paraffins. However, the waxiness may be minimized by introducing a site of unsaturation or a heteroatom into the alkyl chain.

Suitable dialkylcarbonates include dimethylcarbonate and diethylcarbonate. Dimethyl carbonate is preferred.

The resulting alcohol byproduct may be removed by distillation. However, keeping the alcohol in the mixture does improve the fluidity of the final product.

Suitable alkylene carbonates include cyclic ethylene carbonate and propylene carbonate. Propylene carbonate is preferred. There is no alcohol byproduct when an alkylene carbonate is used as a reactant.

Hydrocarbon solvents or other inert solvents may be used in the reaction. Included among useful solvents are benzene, toluene and xylenes. When solvent is used, the preferred solvent is a mixture of xylenes. In general, any hydrocarbon solvent can be used in which the reactants and products are soluble and which can be easily removed.

The condensation reaction with dialkylcarbonate generally proceeds as follows:

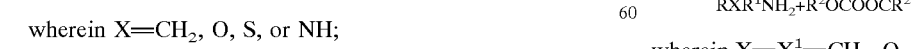

$RXR^1NH_2+R^2OCOOCR^2 \rightarrow RX^1R^1NHCOOR^2+R^2OH$ wherein $X=X^1=CH_2$, O, S, NH; when X=NH, $X^1$ can be $NCOOR^2$ R=hydrogen, hydrocarbyl, alkenyl, alkyl ($C_1$ to $C_{60}$) optionally containing aryl, alkylaryl;

$R^1=C_1$ to $C_4$ alkenyl or substituted alkenyl; and $R^2=C_1$ to $C_4$ alkyl.

The condensation reaction with alkylene carbonate generally proceeds as follows:

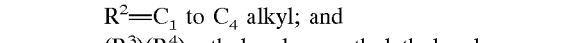

$$RXR^1NH_2+(R^3)OCOO(R^4)\rightarrow RX^1R^1NHCOO(R^3)(R^4)OH$$

wherein X=X$^1$=CH$_2$, O, S, NH; when X=NH, X$^1$ can be NCOO(R$^3$)(R$^4$)OH

R=hydrogen, hydrocarbyl, alkenyl, alkyl ($C_1$ to $C_{60}$) optionally containing aryl, alkylaryl.

R$^1$=$C_1$ to $C_4$ alkenyl or substituted alkenyl;

R$^2$=$C_1$ to $C_4$ alkyl; and (R$^3$)(R$^4$)=ethylenyl or methylethylenyl.

Generally the reaction temperature is in the range of from about ambient to about 165° C. and preferably in the range of from about ambient to about 100° C. The reaction time is generally in the range of from about 1 to about 24 hours and preferably in the range of from about 2 to about 12 hours.

It is preferred to use stoichiometric quantities of amines and dialkylcarbonates and/or alkylene carbonates. However, excess of one or another reagent can be desirable. The generated alcohol, if present, is generally left in the final compound mixtures.

The amount of friction reducing additive in the lubricant composition may range from about 0.1 to about 10% by weight of the total lubricant composition. Preferred is from about 0.1 to about 2.0 wt. %.

In the lubricant additive concentrate the amount of friction reducing additive may range from about 1.0% to about 50.0% by weight of the total lubricant additive concentrate. Preferred is from about 10% to about 30% by weight.

The lubricant composition and/or the lubricant additive concentrate may contain other materials normally present in additive packages including dispersants, detergents, antioxidants, antiwear and extreme pressure agents, viscosity index improvers; corrosion inhibitors, anti-rust additives, antifoam agents, pour point depressants, various markers, taggants, and any solubilizing agents, such as oils, polymers, solvents, and the like. These materials impart their customary properties to the particular compositions and do not detract from the value of the compositions into which they are incorporated.

Suitable dispersants include polyalkylene succinimides, Mannich bases, polyethers, polyalkylene amines, various esters, and the like.

Suitable detergents include metallic and/or non-metallic phenates, sulfonates, carboxylates, and the like.

Suitable antioxidants include hindered phenols, arylated amines, sulfurized olefins, and the like.

Suitable viscosity index improvers include polymethacrylates, olefin copolymers and the like.

Suitable antiwear and extreme pressure agents include zinc dialkyl dithiophosphates, dithiocarbamates, thiodiazoles, and the like.

Generally the total amount of all such other materials will not exceed about 10.0 to 30.0 wt. % in the lube compositions and about 10.0 to about 100.0% of the lube additive concentrates.

Furthermore, the lubricants contemplated for use herein include both mineral and synthetic hydrocarbon oils of lubricating viscosity, mixtures of mineral and synthetic oils and greases prepared therefrom, and other solid lubricants. The synthetic oils may include polyalphaolefins; polyalkylene glycols, such as polypropylene glycol, polyethylene glycol, polybutylene glycol; esters, such as di(2-ethylhexyl) sebacate, dibutyl phthalate, neopentyl esters, such as pentaerythritol esters, trimethyl propane esters; polyisobutylenes; polyphenyls; ethers such as phenoxy phenylethers; fluorocarbons; siloxanes; silicones; silanes and silicate esters; hydrogenated mineral oils or mixtures thereof.

The present invention may also be used in fuels such as gasoline, oxygenated gasolines, reformulated gasolines, gasohols, hydrocarbon fuels, mixed hydrocarbon and oxygenated fuels, jet turbine engine fuels and diesel fuels. The present invention may also be used in fuel additive concentrates.

Fuel compositions can contain from about 10 to about 1,000 pounds of friction reducing additive per 1,000 barrels of fuel or more preferably from about 25 to about 250 pounds per 1,000 barrels of fuel.

In the fuel additive concentrate the amount of friction reducing additive may range from about 1.0% to about 50.0% by weight of the total fuel additive concentrate. Preferred is from about 10% to about 30% by weight.

Fuel and fuel additive concentrates may contain other materials normally present in fuel additive packages including deposit control additives for carburetors, port fuel injectors, intake ports, intake valves, and combustion chambers; carrier fluids; anti-knock agents, such as tetraalkyl lead compounds, organomanganese compounds, lead scavengers, octane enhancing additives, and the like; dyes; markers; taggants; cetane improvers, such as alkyl nitrates, alkyl peroxides, and the like; antioxidants, such as hindered phenols, arylated amines, sulfurized olefins, and the like; rust inhibitors; demulsifiers; bacteriastatic agents; gum inhibitors; anti-icing agents; metal deactivators; exhaust valve anti-recession agents; spark enhancing additives; low temperature solubilizers; solvents necessary for low temperature performances or mixtures thereof.

Suitable demulsifiers include oxyalkylated alkylphenolic (formaldehyde) resins, and polyoxyalkylene glycols.

Suitable carrier fluids include mineral and/or synthetic oils, polyalkylenes, sters, polyols, polyethers or mixtures thereof.

Suitable corrosion inhibitors include alkyl lactic succinate esters.

The fuel and fuel additive concentrates generally comprise an effective amount of at least one detergent. The detergent is normally selected from the group consisting of polyalkyleneamines and Mannich base-type condensation products of hydrocarbyl phenols, aldehydes and amines. Generally, these detergent agents reduce and/or prevent deposits which have a tendency to form in carburetors and fuel injection systems, thereby improving engine performance. Such detergent agents also improve fuel economy and reduce internal combustion engine exhaust emissions.

The preferred polyalkyleneamine detergents are selected from the group consisting of polymeric 1-amines, including polyisobutylene-amines. High vinylic content polyisobutylene-amines are most preferred. Suitable polyisobutylene-amines are described in U.S. Pat. Nos. 5,004,478 and 5,112,364, and DE 3942860, the disclosures of which are incorporated herein in their entirety. Preferred polyisobutylene-amines have an average molecular weight of about 500 to about 3,000 or greater.

Such polyalkyleneamines are available from normal commercial sources or may be prepared by the amination of high vinylic content polyolefins having an average molecular weight of from about 500 to about 3000 or greater, using methods which are well known to those skilled in the art. Polyisobutylene amines are generally prepared by chlorination or hydroformylation of reactive polyisobutylene and subsequent amination with ammonia, hydrocarbyl amines, hydrocarbyl diamines, hydrocarbyl polyamines, alkoxylated hydrocarbyl amines, or mixtures thereof. Ammonia, ethylenediamine, diethylenetriamine, triethylene-tetramine, tetraethylenepentamine, piperazines, hexamethylenediamine, hydroxyalkyl ethylenediamines, hydroxyalkyl triethylenetetraamines, and the like can be incorporated into the polyalkeneamines. Such amines can be prepared by the chlorination or halogenation of appropriate polymeric olefins, and subsequently converted into corresponding polyalkene derivatives using these or other known methods of manufacture.

The amount of polyalkyleneamine in the fuel composition may be at least about 10 to about 200 pounds per 1,000 barrels of fuel and preferably at least about 40 to about 150 pounds per 1,000 barrels of fuel.

The amount of polyalkyleneamine in the fuel additive concentrate may be at least about 10 wt. %, preferably at least about 20 wt. %, and most preferably in the range of from about 25 to about 60 wt. %.

Alternatively, preferred detergent agents are the Mannich base condensation products of hydrocarbyl phenols, aldehydes, and amines. The hydrocarbon-substituted phenols are generally prepared by the alkylation of phenol or phenolics with hydrocarbyl groups having from 10 to 150 carbon atoms. For instance, long chain olefins or polymeric olefins such as propylene and polyisobutylene can be used in the phenol alkylation step. The substituted phenol is then reacted with a carbonyl source and an amine. Carbonyl sources include aldehydes, such as formaldehyde, acetaldehyde, propanal, butanal, and 2-ethylhexanal. In addition, aromatic aldehydes may be used to provide a carbonyl source. For instance, benzaldehyde, tolualdehyde, vanillin, salicylaldehyde, and cinnamaldehyde may be used. Polycarbonyl compounds, such as paraformaldehyde or glyoxal can also be used in some aspects of the invention.

Amines useful in the preparation of the Mannich base condensation product include primary or secondary amines and amides. Fatty amines, hydroxyl-containing amines, or polyamines, such as di-, tri-, tetra- and pentamines can be used in some aspects of the invention. For example, linear and cyclic $C_2$–$C_6$ alkylene di-, tri-, tetra- and pentamines, polyamines, and their substituted polyfunctional derivatives can be used. Substituted derivatives, as used herein, refer to substitution with substituents such as halo, hydroxy, alkoxy, nitro, thio, carbalkoxy and alkythio substituents. Such Mannich base condensation products are available from normal commercial sources. Suitable Mannich base condensation products are described in U.S. Pat. No. 5,169,410, the disclosure of which is incorporated herein in its entirety.

The amount of Mannich base condensation product in the fuel composition may be at least about 10 to about 200 pounds per 1,000 barrels of fuel and preferably at least about 40 to about 150 pounds per 1,000 barrels of fuel.

The amount of Mannich base condensation product in the fuel additive concentrate may be at least about 10 wt. %, preferably at least about 20 wt. %, and most preferably in the range of from about 25 to about 60 wt. %.

A concentrate utilizing the friction reducing additive of the present invention typically also comprises about 15 to about 80% solvent. A preferred composition range is as follows:

| Component | Wt. % Range |
|---|---|
| Carbamate | 5 to 25 |
| Detergent | 20 to 60 |

-continued

| Solvent | Wt. % Range |
|---|---|
| Isopropanol | 0 to 30 |
| Xylene | 15 to 50 |

Where the presently described invention is used as a gasoline additive, the additive package may be added at any point after the gasoline has been refined, i.e. the additive package can be added at the refinery or in the distribution system.

The invention also includes a method for reducing and/or preventing friction in the operation of an internal combustion engine. Additional possible benefits realized from the present invention include enhanced engine cleanliness, enhanced lubricity, enhanced corrosion protection, reduced fuel consumption, increased power benefits, and reduced wear. The method comprises delivering to the internal combustion engine a fuel comprising gasoline and a friction reducing additive, and other materials normally present in additive packages, described above.

The following examples are illustrative of the present invention.

EXAMPLE 1

One hundred ninety five grams (0.7 mole) of a fatty oleylamine (Armeen OL, commercially obtained from Akzo Chemicals, Inc.) and 70 ml. (0.7 mole) of dimethylcarbonate were heated at 100° C. for 2 hours under an inert nitrogen atmosphere. The methanol formed during the reaction was constantly removed by distillation using a moisture trap. Two hundred three grams of a yellow liquid was obtained.

EXAMPLE 2

One thousand nine hundred ninety five grams (7.5 moles) of a fatty cocodiamine, N-coco-1,3-propanediamine (Duomeen C, commercially obtained from Akzo Chemicals, Inc.) and 1350 grams. (15.0 moles) of dimethylcarbonate were heated at reflux for 3.5 hours. Three thousand two hundred ninety two grams of a clear slightly brownish yellow liquid containing about 14 wt. % methanol, was obtained.

EXAMPLE 3

Four hundred grams (1.5 moles) of a fatty cocodiamine, N-coco-1,3-propanediamine (Duomeen C, commercially obtained from Akzo Chemicals, Inc.) and 323.0 grams (3.15 moles) of propylenecarbonate (Texacar PC, commercially obtained from Texaco Chemical Company) in 145 grams of xylenes as solvent were heated at 100° C. for 4 hours then 165° C. for an extra hour. Seven hundred twenty grams of a clear brownish liquid was obtained.

The friction reducing properties of the products in the examples were measured using LVFA (Low Velocity Friction Apparatus) test and/or a Buick 3.8 L Fired Engine test. The additives were dissolved at 1.00 or 0.50 or 0.25 wt. % into a fully formulated 5W-30 mineral engine oil used as reference.

In the LVFA test, the coefficients of friction of the reference oil and the oils containing the products of this invention were measured at 32, 38, 48 and 58 psi over a range of sliding speeds (5–30 ft/min.) at both room temperature and 250° F. and averaged. The percent changes in the coefficients of friction of the test oils relative to the reference oil are reported in Table 1 below. Also reported and used as reference are the results of a commercially available friction modifier, glycerol monooleate (GMO). The larger the percent reduction in the coefficient of friction, the effectiveness of the additive is increased. The N-alkylmethylcarbamate of Example 1 is superior to GMO in friction reduction.

TABLE 1

| Change in the Coefficients of Friction | | | |
|---|---|---|---|
| | Treat Rate | Coefficients of Friction % Reduction | |
| Example | wt. % | Static | Dynamic |
| 1 | 0.5 | 15.5 | 12.0 |
| GMO | 0.5 | 7.0 | 4.0 |

A 3.8 L Fired Engine test measures brake specific fuel consumption (BSFC) for each sample and the results are compared to those of the unadditized engine oil used as reference.

The experiments are generally additive spike additions to the lubricating oil of the engine run at a temperature of 275° F.

The percent reduction in fuel consumption results reported in Table 2 below are percent improvement over the reference oil. The larger the percent reduction in BSFC; the more effective is the additive. Here also, GMO (glycerol monooleate) results were used as reference for comparative reasons.

TABLE 2

| Reduction in Fuel Consumption | | |
|---|---|---|
| Example | Treat Rate wt. % | % Reduction in Fuel Consumption 275° F |
| 1 | 1 | 4.2 |
| 2 | 1 | 4.8 |
| 3 | 1 | 4.1 |
| GMO | 1 | 2.0 |

*No response

As can be seen from the low velocity friction apparatus test results and also from the 3.8 L Fired Engine test results, the products of this invention show exceptional friction reduction properties leading to enhanced fuel economy and better performance than the commercially available friction modifier additive, glycerol monooleate.

The products of the examples were also evaluated with respect to cleanliness during thermal decomposition using TGA (Thermogravimetric Analysis) and the results are compared to a commercially available friction modifier, glycerol monooleate (GMO) as shown in Table 3 below. Thermogravimetric analysis was performed by heating a small sample at 20° C./min. with an air flow of 100 ml/min. using a Thermogravimetric Analyzer. The percent residue remaining at 425° C. was recorded; little or no residue is desirable.

TABLE 3

| Cleanliness | |
|---|---|
| Example | Thermogravimetric Analysis % Residue @ 424° C. |
| 1 | 8.5 |
| 2 | 5.0 |
| 3 | 3.3 |
| GMO | 25.0 |

As can be seen from the thermogravimetric analysis results in Table 3, the products of this invention show exceptionally higher cleanliness than the commercially available friction modifier, GMO. The N-alkylmethylcarbamates of Examples 1 and 2 and The N-alkyl(2-hydroxy propyl)carbamate of Example 3 are superior to GMO in cleanliness.

The results of the LVFA and TGA shown in the above Tables show the superiority of the products of the present invention over the glycerol monooleate as friction reducers as well as in the cleanliness of decomposition. It is also believed that the additional groups on the amides such as hydroxyl, amino, imino and alkoxy contributes to better surface activity in synergy with the amide function.

EXAMPLE 4

Using the reaction product of Example 2, the following fuel additive concentrate formulations are prepared.

| Formulation | A | B | C | D | E | F |
|---|---|---|---|---|---|---|
| Component (Wt. % Range) | 15.0 | 14.88 | 22.7 | 19.46 | 29.7 | 10.0 |
| Example 2 reaction product | | | | | | |
| Detergent | | | | | | |
| Mannich-base condensation product (Ethyl 4961M) | | 30.12 | 47.3 | | 40.3 | 45.0 |
| Polyisobutylene amine (Pluradyne AP-92M) | 30.0 | | | 40.54 | | |
| Solvent | | | | | | |
| isopropanol | 18.33 | 18.33 | 10.0 | 13.3 | 10.0 | 8.0 |
| Xylene | 36.67 | 36.67 | 20.0 | 26.67 | 20.0 | 37.0 |

EXAMPLE 5

Using the reaction product of Example 3, the following fuel additive concentrate formulations are prepared:

| Formulation | A | B | C | D | E | F |
|---|---|---|---|---|---|---|
| Component (Wt. % Range) | 15.0 | 14.88 | 22.7 | 19.46 | 29.7 | 100 |
| Example 3 reaction product | | | | | | |
| Detergent | | | | | | |
| Mannich-base condensation product (Ethyl 4961M) | | 30.12 | 47.3 | | 40.3 | 45.0 |
| Polyisobutylene amine (Pluradyne AP-92M) | 30.0 | | | 40.54 | | |
| Solvent | | | | | | |
| Isopropanol | 18.33 | 18.33 | 10.0 | 13.3 | 10.0 | 8.0 |
| Xylene | 36.67 | 36.67 | 20.0 | 26.67 | 20.0 | 37.0 |

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A lubricant composition comprising a lubricating oil or grease prepared therefrom, a dispersant and a friction reducing amount of a reaction product obtained by reacting $$RXR^1NH_2$$

wherein X=$CH_2$, O, S, or NH;

R=hydrocarbyl $C_1$ to $C_{60}$;

$R^1$=$C_1$ to $C_4$ alkenyl or substituted alkenyl;

and dialkylcarbonate.

2. The lubricant composition of claim 1, further comprising a dispersant.

3. The lubricant composition of claim 1, wherein the lubricating oil is selected from the group consisting of mineral oils, synthetic oils or mixtures thereof.

4. The lubricant composition of claim 1, wherein said dialkylcarbonate is dimethylcarbonate.

5. The lubricant composition of claim 1, wherein the amount of reaction product present is in the range of from about 0.1 to about 10.0 wt. %.

6. The lubricant composition of claim 1, wherein $RXR^1NH_2$ is selected from the group consisting of oleylamine and/or cocodiamine.

7. A lubricant composition comprising a lubricating oil or grease prepared therefrom and a friction reducing amount of a reaction product obtained by reacting alkylamine selected from the group consisting of cocoamine, cocodiamine, oleylamine, oleyldiamine, tallowamine and/or tallowdiamine; and alkylene carbonate.

8. The lubricant composition of claim 7, wherein the alkylamine is oleylamine and/or cocodiamine.

9. The lubricant composition of claim 7, wherein said alkylene carbonate is selected from the group consisting of ethylene carbonate and propylene carbonate.

10. The lubricant composition of claim 7, further comprising a dispersant.

11. The lubricant composition of claim 7, wherein the lubricating oil is selected from the group consisting of mineral oils, synthetic oils or mixtures thereof.

12. The lubricant composition of claim 7, wherein the amount of reaction product present is in the range of from about 0.1 to about 10.0 wt %.

* * * * *